US006747601B2

(12) United States Patent
Boyle

(10) Patent No.: US 6,747,601 B2
(45) Date of Patent: Jun. 8, 2004

(54) ANTENNA ARRANGEMENT

(75) Inventor: Kevin R. Boyle, Horsham (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/196,773

(22) Filed: Jul. 17, 2002

(65) Prior Publication Data

US 2003/0016179 A1 Jan. 23, 2003

(30) Foreign Application Priority Data

Jul. 21, 2001 (GB) ..... 0117882

(51) Int. Cl.[7] ..... H01Q 1/22; H01Q 1/24
(52) U.S. Cl. ..... 343/700 MS; 343/749
(58) Field of Search ..... 343/700 MS, 749, 343/846, 848

(56) References Cited

U.S. PATENT DOCUMENTS 5,537,123 A * 7/1996 Mandai et al. ..... 343/700 MS
6,281,848 B1 * 8/2001 Nagumo et al. ..... 343/700 MS

FOREIGN PATENT DOCUMENTS

EP 0867967 9/1998 ..... H01Q/1/22
WO WO0137369 5/2001 ..... H01Q/1/24

* cited by examiner

*Primary Examiner*—James Clinger
(74) *Attorney, Agent, or Firm*—Gregory L. Thorne

(57) ABSTRACT

An antenna arrangement comprises a patch conductor (102) supported substantially parallel to a ground plane (104), a feed pin (106) connected to the patch conductor at a first point and a ground pin (108) connected between a second point on the patch conductor and the ground plane. The feed and ground pins are connected by a linking conductor (510) and have shunt capacitance means coupled across them. Suitable values of the capacitance means and the location and dimensions of the linking conductor enable a good match to the antenna to be achieved.

The linking conductor may be directly connected to the patch conductor or there may be gaps between the feed and ground pins both above and is below the linking conductor. An impedance transformation may be provided by the feed and ground pins having different cross-sectional areas and/or by the provision of a slot in the patch conductor.

10 Claims, 4 Drawing Sheets

ANTENNA ARRANGEMENT

The present invention relates to an antenna arrangement comprising a substantially planar patch conductor, and to a radio communications apparatus incorporating such an arrangement.

Wireless terminals, such as mobile phone handsets, typically incorporate either an external antenna, such as a normal mode helix or meander line antenna, or an internal antenna, such as a Planar Inverted-F Antenna (PIFA) or similar.

Such antennas are small (relative to a wavelength) and therefore, owing to the fundamental limits of small antennas, narrowband. However, cellular radio communication systems typically have a fractional bandwidth of 10% or more. To achieve such a bandwidth from a PIFA for example requires a considerable volume, there being a direct relationship between the bandwidth of a patch antenna and its volume, but such a volume is not readily available with the current trends towards small handsets. Further, PIFAs become reactive at resonance as the patch height is increased, which is necessary to improve bandwidth.

International patent application WO 01/37369 discloses a PIFA in which matching is achieved by linking feed and shorting pins with a conductive matching element whose dimensions are chosen to provide a suitable impedance match to the antenna. Such an antenna is inherently narrowband.

European patent application EP 0,867,967 discloses a PIFA in which the feed pin is meandered to increase its length, thereby increasing its inductance in an attempt to make the antenna easier to match. A broadband match is difficult to achieve with such an antenna, requiring a small matching capacitance.

Our co-pending unpublished International patent application PCT/IB02/00051 (Applicant's reference PHGB 010009) discloses a variation on a conventional PIFA in which a slot is introduced in the PIFA between the feed pin and shorting pin. Such an arrangement provided an antenna having substantially improved impedance characteristics while requiring a smaller volume than a conventional PIFA.

An object of the present invention is to provide an improved planar antenna arrangement.

According to a first aspect of the present invention there is provided a antenna arrangement comprising a substantially planar patch conductor, a feed pin connected to the patch conductor at a first point and a ground pin connected between a second point on the patch conductor and a ground plane, wherein the arrangement further comprises a linking conductor connecting the feed and ground pins and shunt capacitance means coupled between the feed and ground pins, wherein the location and dimensions of the linking conductor and value of the capacitance means are selected to enable a good match to the antenna to be achieved.

The presence of the linking conductor acts to reduce the length of the short circuit transmission line formed by the feed and ground pins, and hence its inductance, enabling the value of the shunt capacitance to be increased which provides improved bandwidth. The linking conductor may also be connected to the patch conductor, or there may be gaps between the pins both above and below the linking conductor. By arranging for the matching inductance to be provided as part of the antenna structure, the inductance has a higher Q than that provided by circuit solutions at no additional cost.

The feed and ground pins may have different cross-sectional areas, to provide an impedance transformation.

Alternatively, or in addition, one or both of the feed and ground pins may be formed of a plurality of conductors to provide an impedance transformation. The impedance transformation may also be provided by a slot in the patch conductor between the feed and ground pins, as disclosed in PCT/IB02/00051.

According to a second aspect of the present invention there is provided a radio communications apparatus including an antenna arrangement made in accordance with the present invention.

Embodiments of the present invention will now be described, by way of example, with reference to the accompanying drawings, wherein.

In the drawings the same reference numerals have been used to indicate corresponding features.

Figure 1:
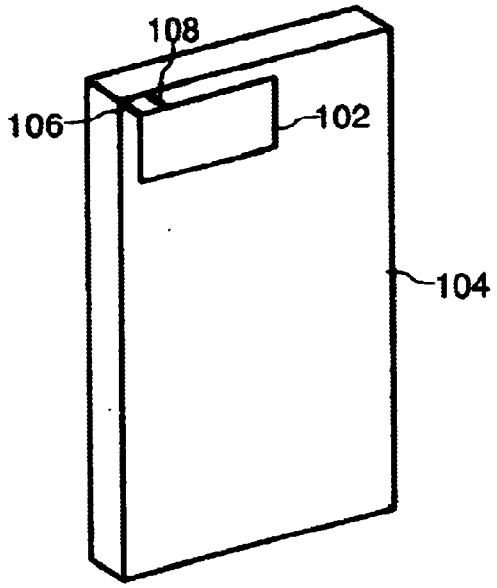
FIG. 1 is a perspective view of a PIFA mounted on a handset.

A perspective view of a PIFA mounted on a handset is shown in FIG. 1. The PIFA comprises a rectangular patch conductor 102 supported parallel to a ground plane 104 forming part of the handset. The antenna is fed via a feed pin 106, and connected to the ground plane 104 by a shorting pin 108 (also known as a ground pin). The feed and shorting pins are typically parallel for convenience of construction, but this is not essential for the functioning of the antenna.

In a typical example embodiment of a PIFA the patch conductor 102 has dimensions 20×10 mm and is located 8 mm above the ground plane 104 which measures 40×100×1 mm. The feed pin 106 is located at a corner of both the patch conductor 102 and ground plane 104, and the shorting pin 108 is separated from the feed pin 106 by 3 mm. Each of the pins 106,108 is planar with a width of 1 mm.

It is well known that the impedance of a PIFA is inductive. One explanation for this is provided by considering the currents on the feed and shorting pins 106, 108 as the sum of differential mode (equal and oppositely directed, non-radiating) and common mode (equally directed, radiating) currents. For the differential mode currents, the feed and shorting pins 106, 108, form a short-circuit transmission line, which has an inductive reactance because of its very short length relative to a wavelength (8 mm, or 0.05λ at 2 GHz, in the embodiment shown in FIG. 1). This inductive reactance acts like a shunt inductance across the antenna feed. In order to match to the antenna 102, shunt capacitance needs to be provided between the feed and shorting pins 106, 108 to tune out the inductance by resonating with it at the resonant frequency of the antenna. Although this can be provided by a shunt capacitor, in known PIFAs it is typically provided by modifying the antenna geometry. For example, this may be done by extending the patch conductor 102 towards the ground plane 104 close to the feed pin 106 to provide some additional capacitance to ground.

Figure 2:
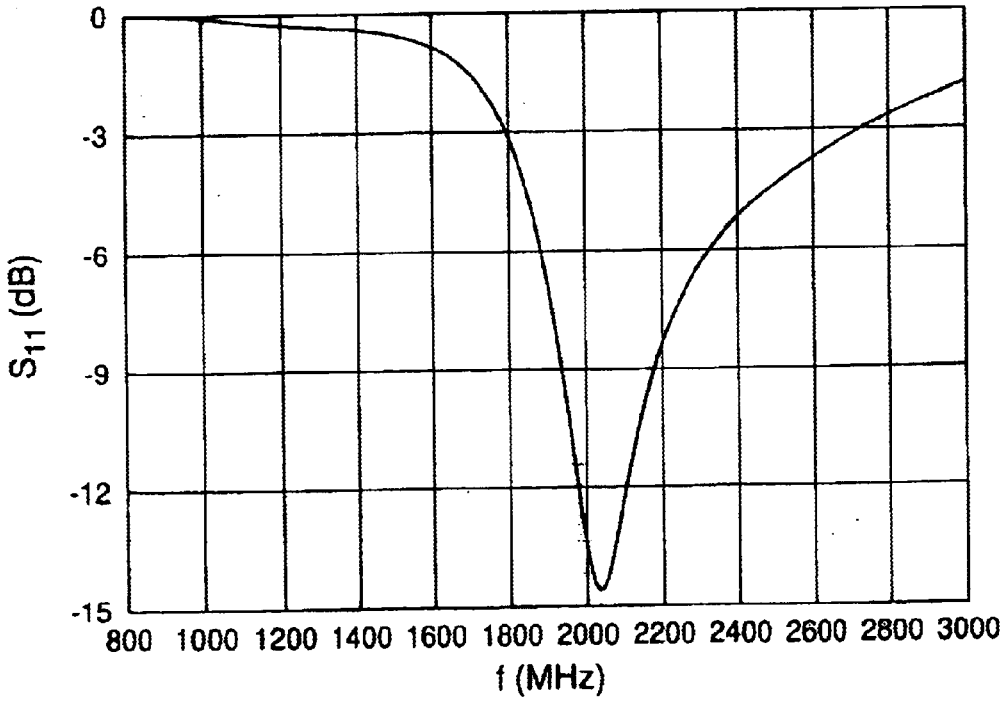
FIG. 2 is a graph of simulated return loss $S_{11}$ in dB against frequency in MHz for the antenna of FIG. 1 matched with a 0.45 pF capacitor.
Figure 3:
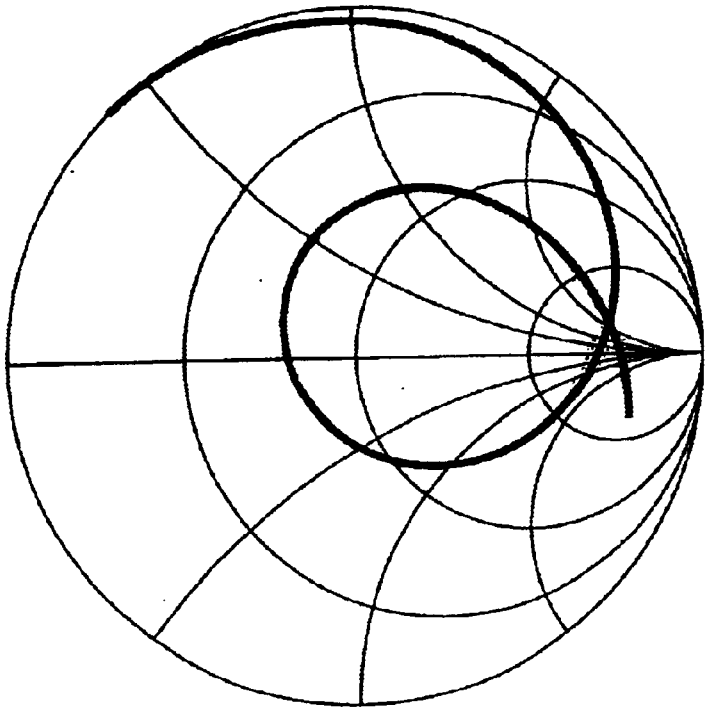
FIG. 3 is a Smith chart showing the simulated impedance of the antenna of FIG. 1, matched with a 0.45 pF capacitor, over the frequency range 800 to 3000 MHz.
Figure 4:
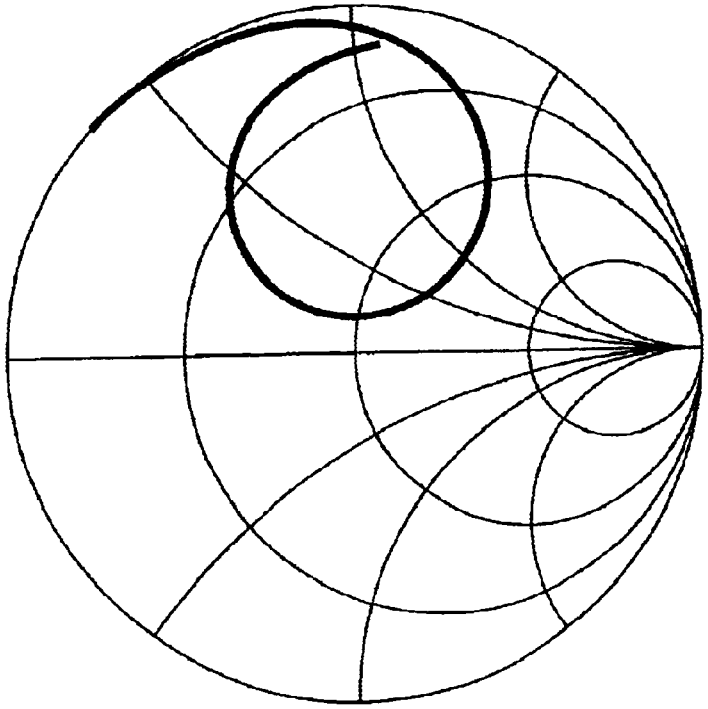
FIG. 4 is a Smith chart showing the simulated impedance of the antenna of FIG. 1, without matching, over the frequency range 800 to 3000 MHz.

The return loss $S_{11}$ of the combined antenna 102 and ground plane 104 shown in FIG. 1 was simulated using the High Frequency Structure Simulator (HFSS), available from Ansoft Corporation. When matched with a 0.45 pF shunt capacitor, the results are shown in FIG. 2 for frequencies f between 800 and 3000 MHz (referenced to 120Ω). A Smith chart illustrating the simulated impedance over the same frequency range is shown in FIG. 3. A further Smith chart illustrating the simulated impedance without the matching capacitor is shown in FIG. 4, demonstrating the inductive nature of the impedance without matching.

This antenna arrangement has a 6 dB bandwidth of approximately 440 MHz and a 10 dB bandwidth of approximately 200 MHz. The bandwidth could be significantly improved if the shunt inductance of the transmission line were reduced and the value of the capacitor increased. This is because, as a first approximation, the antenna looks like a series resonant LCR circuit with substantially constant resistance. Such a circuit is best broadbanded by a complementary parallel LC circuit. Reducing the inductance of the parallel circuit (provided by the short circuit transmission line) and increasing the capacitance provides a response which complements the antenna response better and is therefore more effective at improving bandwidth.

Figure 5:
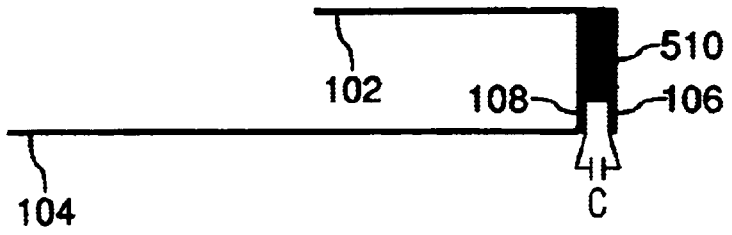
FIG. 5 is a side view of an antenna feed arrangement made in accordance with the present invention.

This aim can be achieved, in accordance with the present invention, by modifying the feeding arrangement as shown in side view in FIG. 5. In this modification, a linking conductor 510 is provided which connects the feed and shorting pins 106, 108 together over most of their length. As shown in FIG. 5 the linking conductor connects the feed and shorting pins 106, 108 from the points at which they contact the patch conductor 102 and is therefore also connected to the patch conductor 102. However, this arrangement is not essential and in alternative embodiments there could be a gap between the pins 106, 108 both above and below the linking conductor 510. This is because the linking conductor provides a path between the pins 106, 108 for differential mode current while having minimal effect on the common mode current. Hence, providing the linking conductor 510 has sufficient height to form (together with the feed and shorting pins 106, 108) a short circuit transmission line, it is not necessary for it to continue as far as the patch conductor and the linking conductor 510 could simply comprise a thin strap.

Figure 6:
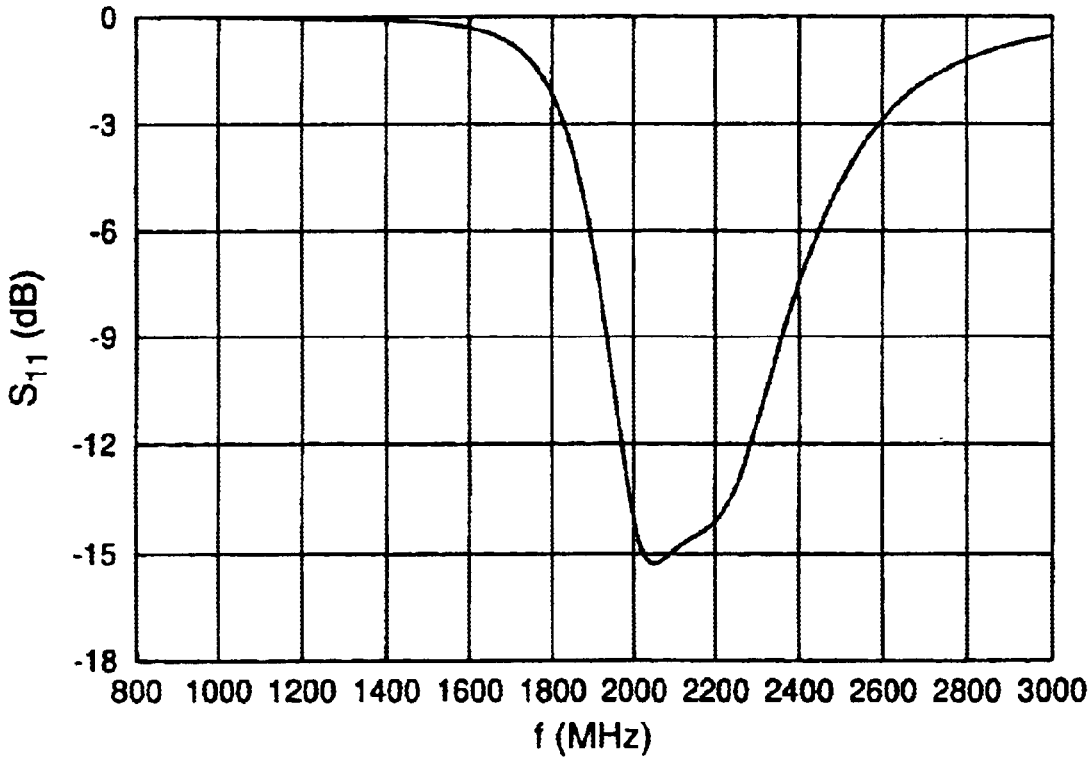
FIG. 6 is a graph of simulated return loss $S_{11}$ in dB against frequency in MHz for a PIFA fed via the feed arrangement of FIG. 5 and matched with a 1.75 pF capacitor.
Figure 7:
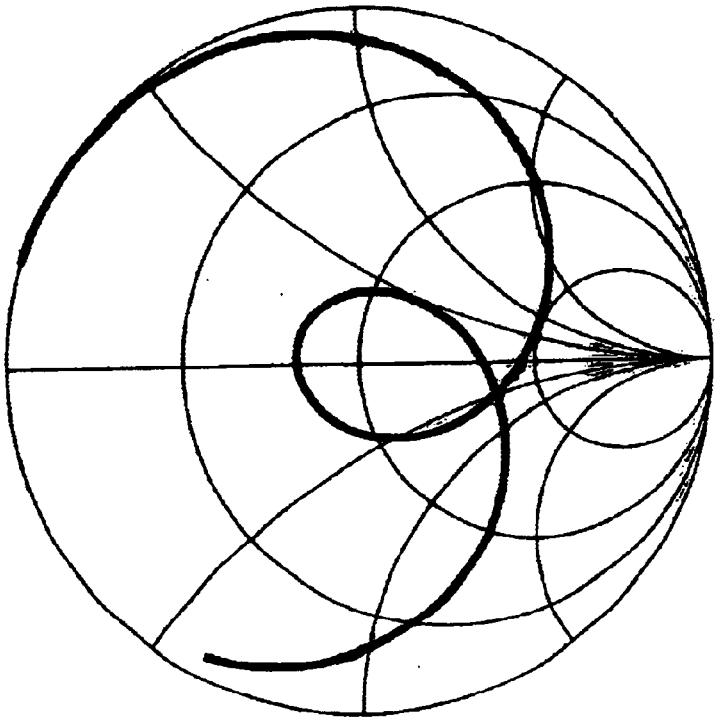
FIG. 7 is a Smith chart showing the simulated impedance of a PIFA fed via the feed arrangement of FIG. 5 and matched with a 1.75 pF capacitor over the frequency range 800 to 3000 MHz.

As an example, simulations to determine return loss $S_{11}$ were performed in which the conductor 510 had a length of 6 mm, leaving the feed and shorting pins 106, 108 unconnected for 2 mm of their length. When matched with a 1.75 pF shunt capacitor, the results are shown in FIG. 6 for frequencies f between 800 and 3000 MHz (referenced to 1200). A Smith chart illustrating the simulated impedance over the same frequency range is shown in FIG. 7. Compared to the conventional PIFA of FIG. 1 the 6 dB bandwidth is improved by 25% to 550 MHz, while the 10 dB bandwidth is almost doubled, to 390 MHz. This improved bandwidth can clearly be seen by comparing the Smith charts shown in FIGS. 7 and 3.

Figure 8:
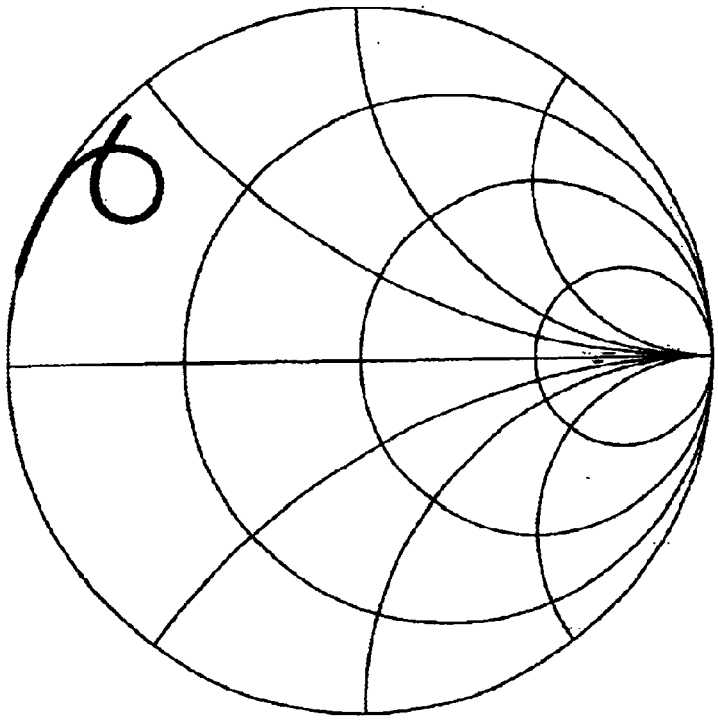
FIG. 8 is a Smith chart showing the simulated impedance of a PIFA fed via the feed arrangement of FIG. 5, without matching, over the frequency range 800 to 3000 MHz.

A further Smith chart illustrating the simulated impedance without the matching capacitor is shown in FIG. 8, which demonstrates that the match without the capacitor is very poor. This is in complete contrast to the antenna arrangement disclosed in WO 01/37369, in which no additional matching components are employed. Such an arrangement requires a low common mode resistance, so that when a shunt inductance is applied a match to 50Ω can be achieved. This restriction means that the antenna will be inherently narrowband.

It is clear that even better performance could be achieved by increasing the length of the linking conductor 510 and using a higher-valued capacitor.

The impedance to which the antenna is matched can be changed by altering the relative thicknesses of the feed and shorting pins 106, 108, as discussed in our co-pending unpublished International patent application PCT/IB02/00051. (Applicant's reference PHGB010009). This is because the common mode current is the sum of the currents in the feed and shorting pins 106, 108, and hence by altering their relative thicknesses (and hence impedances) the ratio of current between the pins can be varied. For example, if the cross-sectional area of the shorting pin 108 is increased, reducing its impedance, the common mode current on the feed pin 106 will be reduced and the effective impedance of the antenna will be increased. Such an effect could also be achieved by replacing one or both of the feed and shorting pins 106, 108 by a plurality of conductors connected in parallel, or by a combination of the two approaches.

An impedance transformation could also be arranged by the provision of a slot in the patch conductor 102 between the feed and shorting pins 106, 108, as disclosed in PCT/IB02/00051. By arranging the slot asymmetrically in the patch conductor the relative currents carried by the feed and shorting pins 106, 108 can be varied since the patch conductor 102 then appears as a short-circuit two-conductor transmission line having conductors of different dimensions. In a mobile phone embodiment, where the patch conductor 102 could be printed on an internal surface of the phone casing, such an arrangement has the advantage of enabling a range of antenna impedances to be provided by different patch conductor configurations while using common feed and ground pins 106, 108 (which could be provided as sprung contacts).

Although the present invention has been described in relation to a single band PIFA, it will be apparent that it could easily be applied to dual or multi-band configurations. In such embodiments, a suitable capacitance for each band could easily be provided via a frequency-selective passive network. It will also be apparent that the required capacitance could be provided as an integrated part of the antenna structure, by a range of known techniques, instead of being provided as one or more discrete capacitors.

Although described in detail above with reference to a PIFA, the present invention has wider applicability and can be used with any monopole-like antenna arrangement where the antenna feed arrangement can be considered as comprising two transmission lines and where the lengths of the transmission lines are selected so that the transmission line impedances can be used in conjunction with complementary circuit elements, thereby providing broader bandwidth and better filtering. (A PIFA may be considered as a very short monopole antenna having a large top-load.)

In the PIFA arrangement described above the transmission lines were short-circuit transmission lines and the circuit elements were capacitors. However, an alternative arrangement is possible in which the transmission lines are open circuit (with a capacitive impedance) and the complementary circuit elements are inductors. Such an arrangement could be formed by modifying the PIFA of FIG. 5 by removing the linking conductor 510 and providing a slot in the patch conductor 102, the slot extending to the edge of the patch conductor and having its length chosen to provide a suitable capacitive impedance for matching with an inductor.

Although an open-circuit arrangement is possible, use of short-circuit transmission lines is still preferred since this enables the use of capacitors as the complementary circuit element. Capacitors generally have a higher Q (typically about 200 at mobile communications frequencies) compared to inductors (typically about 40), and also have better tolerances. Putting the inductance on the antenna substrate (air in the case of a PIFA) means that it can be high quality and used in conjunction with a high quality discrete capacitor. In some cases it may be beneficial to form a capacitor directly on the antenna substrate (for example in the case of an open-circuit transmission line), particularly if the available circuit technology is poor.

What is claimed is:

1. A antenna arrangement comprising a substantially planar patch conductor, a feed pin connected to the patch conductor at a first point and a ground pin connected between a second point on the patch conductor and a ground plane, wherein the arrangement further comprises a linking conductor connecting the feed pin and the ground pins and shunt capacitance means coupled between the feed pin and the ground pins, wherein the location and dimensions of the linking conductor and value of the capacitance means are selected to enable a suitable match to the antenna to be achieved.

2. An arrangement as claimed in claim 1, characterised in that the ground plane is spaced from, and co-extensive with, the patch conductor.

3. An arrangement as claimed in claim 1, characterised in that cross-sectional areas of the feed pin and the ground pins are different.

4. An arrangement as claimed in claim 1, characterised in that the feed pin comprises a plurality of conductors.

5. An arrangement as claimed in claim 1, characterised in that the ground pin comprises a plurality of conductors.

6. An arrangement as claimed in claim 1, characterised in that the feed pin and the ground pins are substantially parallel.

7. An arrangement as claimed in claim 1, characterised in that the capacitance means comprises a discrete capacitor.

8. An arrangement as claimed in claim 1, characterised in that the upper edge of the linking conductor is connected to the patch conductor.

9. An arrangement as claimed in claim 1, characterised in that the patch conductor incorporates a slot between the first and second points.

10. A radio communications apparatus including an antenna arrangement as claimed in claim 1.

* * * * *